US010439269B2

(12) United States Patent
Wei et al.

(10) Patent No.: US 10,439,269 B2
(45) Date of Patent: Oct. 8, 2019

(54) MOBILE DEVICE AND ANTENNA STRUCTURE

(71) Applicant: Wistron NeWeb Corp., Hsinchu (TW)

(72) Inventors: Shih-Chiang Wei, Hsinchu (TW); Yu-Yu Chiang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 111 days.

(21) Appl. No.: 15/712,064

(22) Filed: Sep. 21, 2017

(65) Prior Publication Data

US 2018/0323495 A1 Nov. 8, 2018

(30) Foreign Application Priority Data

May 4, 2017 (TW) ..... 106114777 A

(51) Int. Cl.

| | |
|---|---|
| ***H01Q 1/24*** | (2006.01) |
| ***H01Q 5/328*** | (2015.01) |
| ***H01Q 5/321*** | (2015.01) |
| ***H01Q 5/392*** | (2015.01) |
| ***H01Q 1/22*** | (2006.01) |
| ***H01Q 21/28*** | (2006.01) |
| ***H01Q 5/385*** | (2015.01) |

(52) U.S. Cl.

CPC ..... *H01Q 1/243* (2013.01); *H01Q 1/2266* (2013.01); *H01Q 1/2291* (2013.01); *H01Q 5/321* (2015.01); *H01Q 5/328* (2015.01); *H01Q 5/385* (2015.01); *H01Q 5/392* (2015.01); *H01Q 21/28* (2013.01)

(58) Field of Classification Search

CPC ..... H01Q 1/243; H01Q 5/328; H01Q 5/321; H01Q 5/392

See application file for complete search history.

(56) References Cited

U.S. PATENT DOCUMENTS

| | | | | |
|---|---|---|---|---|
| 2006/0145923 | A1* | 7/2006 | Autti | H01Q 1/243 343/700 MS |
| 2009/0284433 | A1* | 11/2009 | Tsutsumi | H01Q 1/243 343/825 |
| 2012/0218151 | A1* | 8/2012 | Wong | H01Q 1/243 343/700 MS |

(Continued)

FOREIGN PATENT DOCUMENTS

| | | |
|---|---|---|
| CN | 201060926 Y | 5/2008 |

*Primary Examiner* — Dameon E Levi
*Assistant Examiner* — Jennifer F Hu

(57) ABSTRACT

A mobile device includes a supporting element, a ground element, and an antenna structure. The antenna structure includes a first feeding radiation element, a second feeding radiation element, a first parasitic radiation element, a second parasitic radiation element, and a third parasitic radiation element. The first feeding radiation element and the second feeding radiation element are both coupled to a signal feeding point. Each of the first parasitic radiation element, the second parasitic radiation element, and the third parasitic radiation element is coupled to the ground element. A first coupling gap is formed between the first parasitic radiation element and the first feeding radiation element. A second coupling gap is formed between the second parasitic radiation element and the first feeding radiation element. A third coupling gap is formed between the third parasitic radiation element and the second feeding radiation element.

19 Claims, 8 Drawing Sheets

(56) References Cited

U.S. PATENT DOCUMENTS

| | | | | |
|---|---|---|---|---|
| 2012/0274538 | A1* | 11/2012 | Tsou | H01Q 1/243 343/876 |
| 2014/0111386 | A1* | 4/2014 | Xu | H01Q 1/243 343/700 MS |
| 2014/0320349 | A1* | 10/2014 | Lee | H01Q 1/243 343/700 MS |
| 2014/0340265 | A1* | 11/2014 | Vazquez | H01Q 9/42 343/702 |

* cited by examiner

MOBILE DEVICE AND ANTENNA STRUCTURE

CROSS REFERENCE TO RELATED APPLICATIONS

This Application claims priority of Taiwan Patent Application No. 106114777 filed on May 4, 2017, the entirety of which is incorporated by reference herein.

BACKGROUND OF THE INVENTION

Field of the Invention

The disclosure generally relates to a mobile device, and more particularly, to a mobile device and a multiband antenna structure therein.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

In order to improve the device's appearance, designers often incorporate metal elements into mobile devices. However, these added metal elements tend to negatively affect the antennas used for wireless communication in mobile devices, thereby degrading the overall communication quality of mobile devices. As a result, there is a need to propose a novel mobile device with a novel antenna structure, so as to overcome the problems of the prior art.

BRIEF SUMMARY OF THE INVENTION

In an exemplary embodiment, the disclosure is directed to a mobile device including a supporting element, a ground element, and an antenna structure. The supporting element has a first surface and a second surface. The antenna structure is disposed on the first surface of the supporting element. The antenna structure includes a first feeding radiation element, a second feeding radiation element, a first parasitic radiation element, a second parasitic radiation element, and a third parasitic radiation element. The first feeding radiation element and the second feeding radiation element are coupled to a signal feeding point. The first parasitic radiation element, the second parasitic radiation element, and the third parasitic radiation element are coupled to the ground element. A first coupling gap is formed between the first parasitic radiation element and the first feeding radiation element. A second coupling gap is formed between the second parasitic radiation element and the first feeding radiation element. A third coupling gap is formed between the third parasitic radiation element and the second feeding radiation element.

In another exemplary embodiment, the disclosure is directed to an antenna structure including a first feeding radiation element, a second feeding radiation element, a first parasitic radiation element, a second parasitic radiation element, and a third parasitic radiation element. The first feeding radiation element and the second feeding radiation element are coupled to a signal feeding point. The first parasitic radiation element, the second parasitic radiation element, and the third parasitic radiation element are coupled to a ground element. A first coupling gap is formed between the first parasitic radiation element and the first feeding radiation element. A second coupling gap is formed between the second parasitic radiation element and the first feeding radiation element. A third coupling gap is formed between the third parasitic radiation element and the second feeding radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
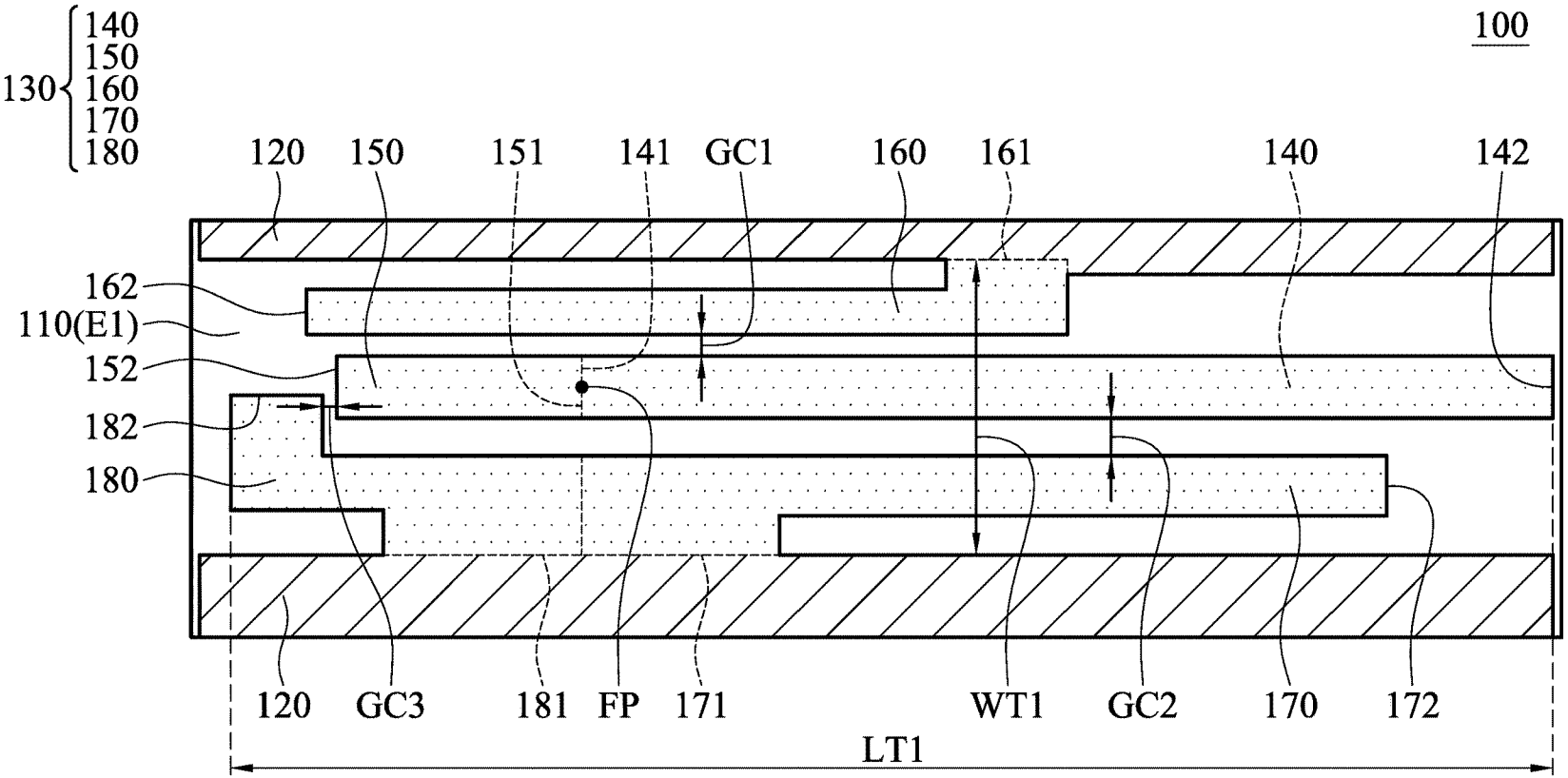
FIG. 1A is a plane expansion view of a mobile device according to an embodiment of the invention.
Figure 1B:
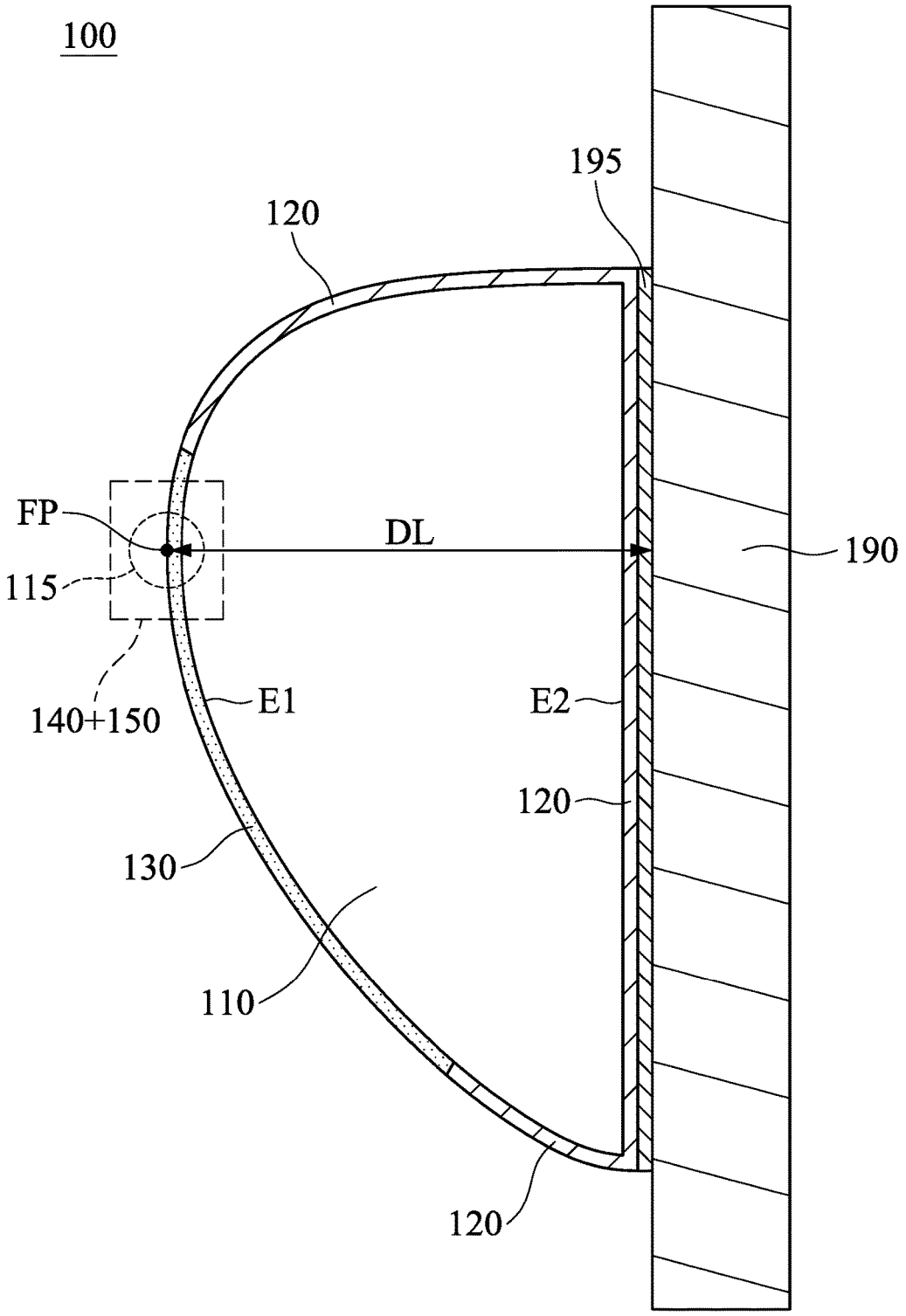
FIG. 1B is a side sectional view of a mobile device according to an embodiment of the invention.

FIG. 1A is a plane expansion view of a mobile device 100 according to an embodiment of the invention. FIG. 1B is a side sectional view of the mobile device 100 according to an embodiment of the invention. The mobile device 100 may be a smart phone, a tablet computer, or a notebook computer. Please refer to FIG. 1A and FIG. 1B. In the embodiment of FIG. 1A and FIG. 1B, the mobile device 100 at least includes a supporting element 110, a ground element 120, and an antenna structure 130. It should be noted that the mobile device 100 may further include other components, such as a display device, a touch control module, a speaker, a battery, and a housing although they are not displayed in FIG. 1A and FIG. 1B.

The supporting element 110 may be made of a nonconductive material, such as a dielectric substrate, a flexible printed circuit board (FPCB), or a plastic fixing element. The supporting element 110 has a first surface E1 and a second surface E2. For example, the first surface E1, or at least a portion of the first surface E1, of the supporting element 110 may have a smooth arc-shape, and the whole second surface E2 of the supporting element 110 may be planar. The ground element 120 may be a ground metal foil for covering the supporting element 110. For example, the ground element 120 may extend from the second surface E2 to the first surface E1 of the supporting element 110, so as to cover the whole second surface E2 and a portion of the first surface E1. The antenna structure 130 has a signal feeding point FP, which may be coupled to a radio frequency (RF) module (not shown). The supporting element 110 is configured to support the antenna structure 130. The antenna structure 130 may be formed on the supporting element 110 using laser direct structuring (LDS) technology. For example, the antenna structure 130 may be disposed on the first surface E1 of the supporting element 110, and the antenna structure 130 may have a three-dimensional (3D) arc-shape.

Specifically, the antenna structure 130 includes a first feeding radiation element 140, a second feeding radiation element 150, a first parasitic radiation element 160, a second parasitic radiation element 170, and a third parasitic radiation element 180, and their arrangements may be described as follows. The first feeding radiation element 140 may substantially have a straight-line shape. The first feeding radiation element 140 has a first end 141 and a second end 142. The first end 141 of the first feeding radiation element 140 is coupled to the signal feeding point FP. The second end 142 of the first feeding radiation element 140 is open. The second feeding radiation element 150 may substantially have a straight-line shape. The second feeding radiation element 150 has a first end 151 and a second end 152. The first end 151 of the second feeding radiation element 150 is coupled to the signal feeding point FP. The second end 152 of the second feeding radiation element 150 is open. The second end 142 of the first feeding radiation element 140 and the second end 152 of the second feeding radiation element 150 may substantially extend in opposite directions. The first parasitic radiation element 160 may substantially have an L-shape. The first parasitic radiation element 160 has a first end 161 and a second end 162. The first end 161 of the first parasitic radiation element 160 is coupled to the ground element 120. The second end 162 of the first parasitic radiation element 160 is open. The second end 162 of the first parasitic radiation element 160 may substantially extend parallel to the first feeding radiation element 140, such that a first coupling gap GC1 is formed between the first parasitic radiation element 160 and the first feeding radiation element 140. The second parasitic radiation element 170 may substantially have an L-shape. The second parasitic radiation element 170 has a first end 171 and a second end 172. The first end 171 of the second parasitic radiation element 170 is coupled to the ground element 120. The second end 172 of the second parasitic radiation element 170 is open. The second end 172 of the second parasitic radiation element 170 may substantially extend parallel to the first feeding radiation element 140, such that a second coupling gap GC2 is formed between the second parasitic radiation element 170 and the first feeding radiation element 140. The second end 172 of the second parasitic radiation element 170 and the second end 162 of the first parasitic radiation element 160 may substantially extend away from each other. The third parasitic radiation element 180 may substantially have an N-shape. The third parasitic radiation element 180 has a first end 181 and a second end 182. The first end 181 of the third parasitic radiation element 180 is coupled to the ground element 120. The second end 182 of the third parasitic radiation element 180 is open. The second end 182 of the third parasitic radiation element 180 may extend and at least partially surround the second end 152 of the second feeding radiation element 150, such that a third coupling gap GC3 is formed between the third parasitic radiation element 180 and the second feeding radiation element 150. It should be noted that each of the first parasitic radiation element 160, the second parasitic radiation element 170, and the third parasitic radiation element 180 is completely separated from the first feeding radiation element 140 and the second feeding radiation element 150. The first parasitic radiation element 160 can be separated from the second parasitic radiation element 170 and the third parasitic radiation element 180 by a structure of the first feeding radiation element 140 connected to the second feeding radiation element 150. For example, the first parasitic radiation element 160 may be positioned at an upper side of the first feeding radiation element 140 and the second feeding radiation element 150, and the second parasitic radiation element 170 and the third parasitic radiation element 180 may be positioned at a lower side of the first feeding radiation element 140 and the second feeding radiation element 150.

The operation theory of the antenna structure 130 may be as follows. The first parasitic radiation element 160 is excited by the first feeding radiation element 140 using a coupling mechanism, so as to form a low-frequency band. The second parasitic radiation element 170 is further excited by the first feeding radiation element 140 using a coupling mechanism, so as to widen the aforementioned low-frequency band. In addition, the third parasitic radiation element 180 is excited by the second feeding radiation element 150 using a coupling mechanism, so as to form a high-frequency band. In alternative embodiments, the antenna structure 130 is independently used as a multiband antenna (it is not necessarily integrated with the mobile device 100). For example, the antenna structure 130 may have a duplicate, in which one is arranged as a reception antenna, and the other one is arranged as a transmission antenna, so as to form an antenna system.

Please refer to FIG. 1B again. In some embodiments, the mobile device 100 further includes a metal back cover 190. The metal back cover 190 is disposed adjacent to the supporting element 110. The metal back cover 190 may be coupled through a conductive material 195 to the ground element 120. For example, the conductive material 195 may be a conductive sponge, a spring, a screw, or a hook, and it can connect or attach the metal back cover 190 to the ground element 120 on the second surface E2 of the supporting element 110. In preferable embodiments, the first feeding radiation element 140 and the second feeding radiation element 150 of the antenna structure 130 (including the signal feeding point FP) are positioned at a peak point 115 of the smooth arc-shape of the first surface E1 of the supporting element 110, and therefore the first feeding radiation element 140 and the second feeding radiation element 150 have the longest perpendicular distance to the metal back cover 190 over the whole supporting element 110. That is, when the first feeding radiation element 140 and the second feeding radiation element 150 are designed at the peak point 115 of the supporting element 110, the distance DL from the first feeding radiation element 140 and the second feeding radiation element 150 to the metal back cover 190 can reaches its maximum value. With such a design, the metal back cover 190 is considered as an extension portion of the ground element 120. The metal back cover 190 does not negatively affect the radiation performance of the antenna structure 130 because it is as away the first feeding radiation element 140 and the second feeding radiation element 150 as possible. Therefore, the invention has at least the advantages of improving the device appearance, maintaining the antenna efficiency, and covering the wideband operation. Alternatively, the first feeding radiation element 140 can be positioned at a point (fig. not shown) on the first surface E1 of the supporting element 110 having a perpendicular distance to the metal back cover 190 at least greater than fifty percent of the longest perpendicular distance DL between the point and the metal back cover 119.

Figure 2A:
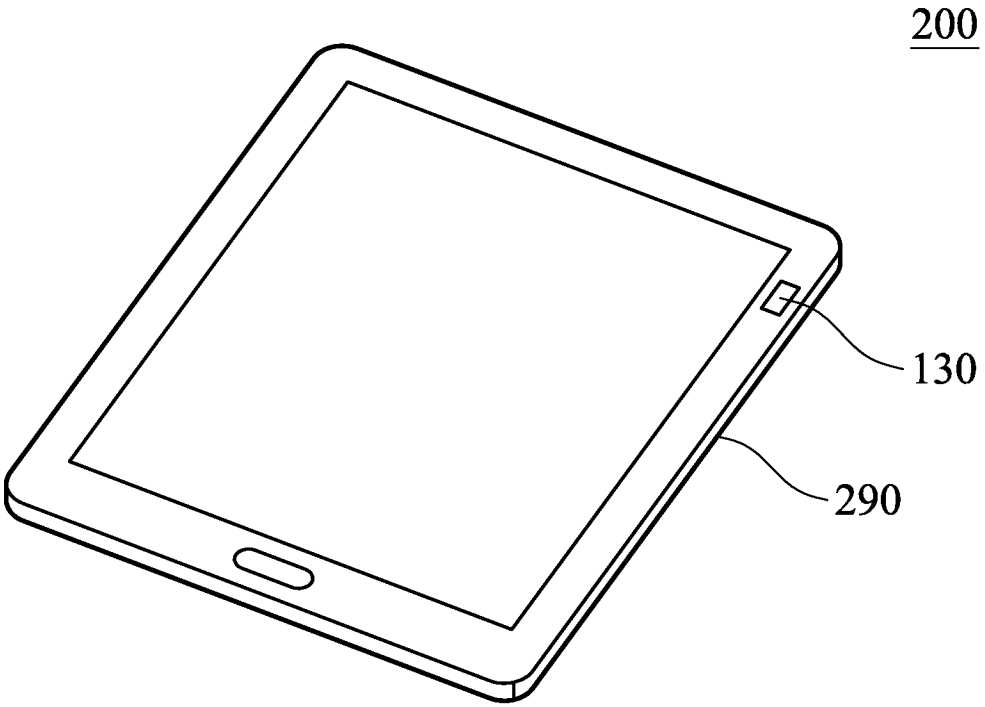
FIG. 2A is a diagram of a mobile device according to an embodiment of the invention.
Figure 2B:
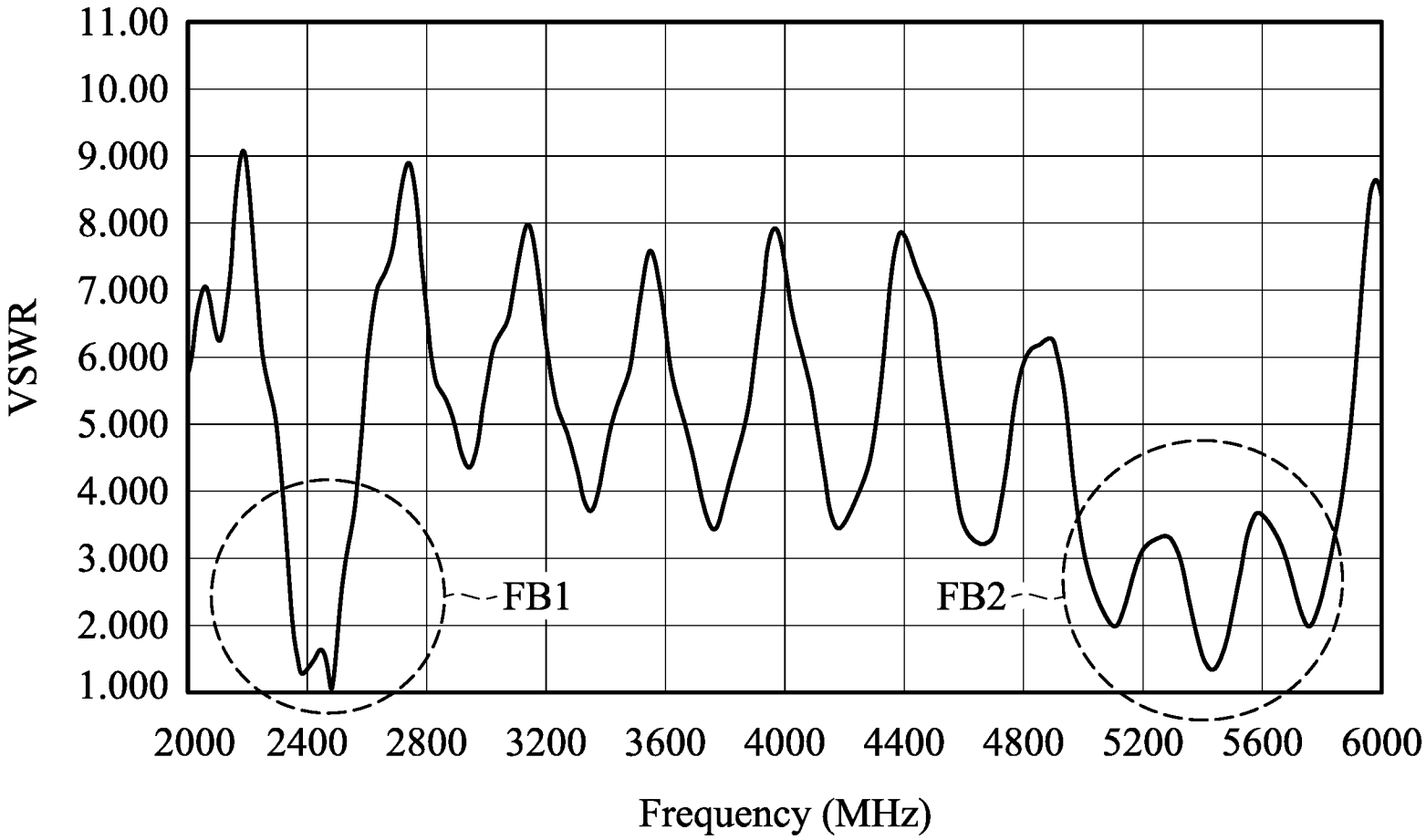
FIG. 2B is a diagram of voltage standing wave ratio (VSWR) relative to an antenna structure of a mobile device according to an embodiment of the invention.

FIG. 2A is a diagram of a mobile device 200 according to an embodiment of the invention. In the embodiment of FIG. 2A, the mobile device 200 is a tablet computer and includes a metal back cover 290. The aforementioned antenna structure 130 may be applied in the mobile device 200 and adjacent to the metal back cover 290. FIG. 2B is a diagram of voltage standing wave ratio (VSWR) relative to the antenna structure 130 of the mobile device 200 according to an embodiment of the invention. According to the measurement of FIG. 2B, the antenna structure 130 of the mobile device 200 can at least cover a low-frequency band FB1 and a high-frequency band FB2. The low-frequency band FB1 may be from about 2400 MHz to about 2500 MHz. The high-frequency band FB2 may be from about 5150 MHz to about 5850 MHz.

Figure 3A:
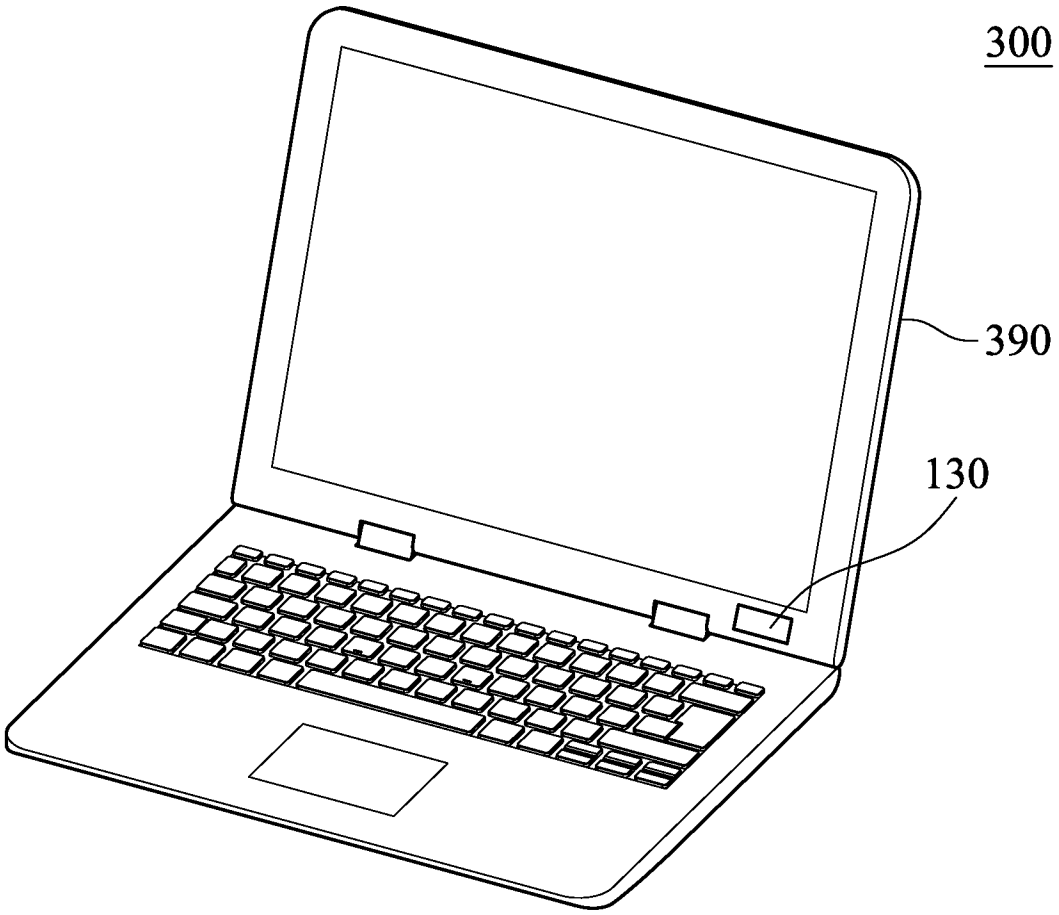
FIG. 3A is a diagram of a mobile device according to an embodiment of the invention.
Figure 3B:
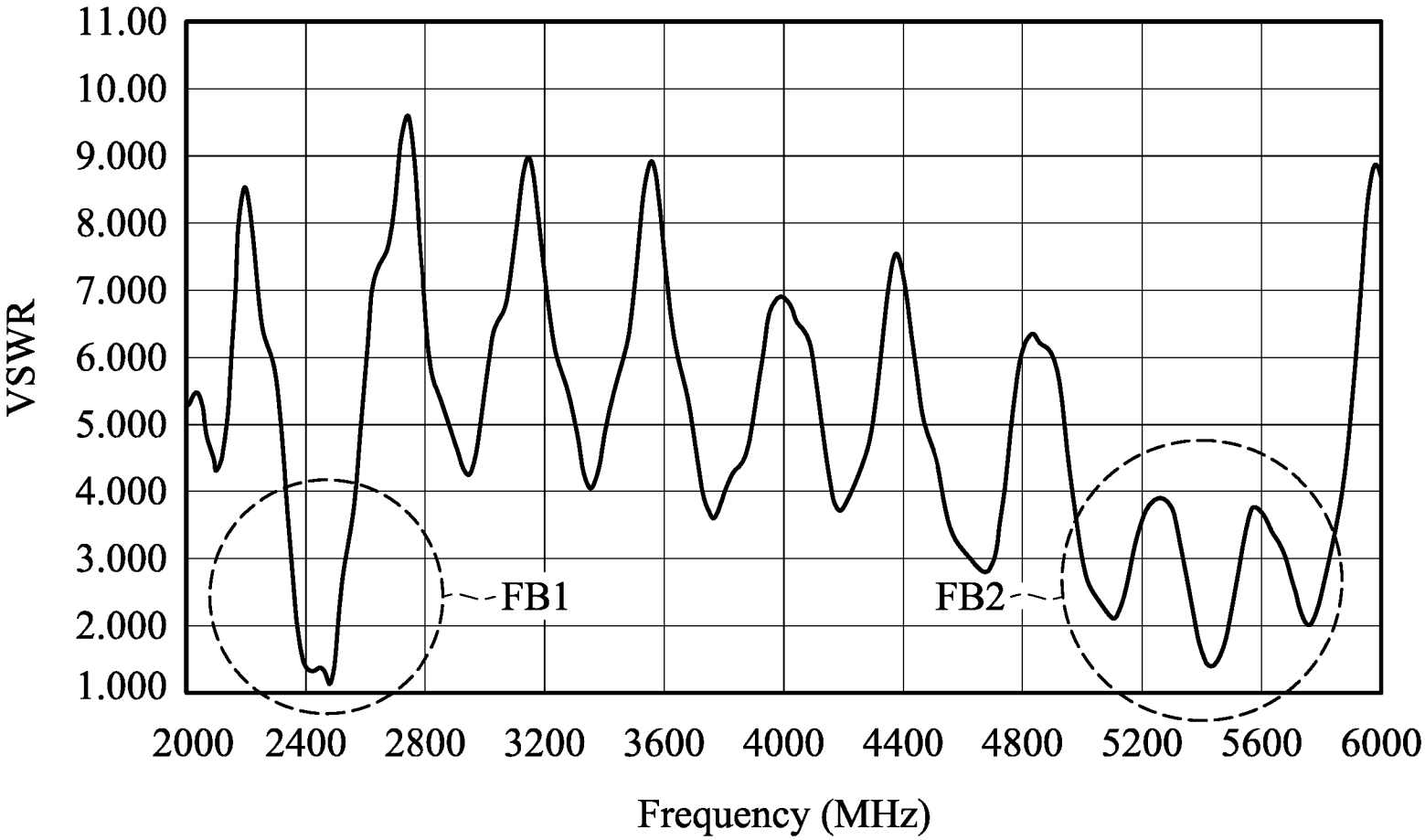
FIG. 3B is a diagram of VSWR relative to an antenna structure of a mobile device according to an embodiment of the invention.

FIG. 3A is a diagram of a mobile device 300 according to an embodiment of the invention. In the embodiment of FIG. 3A, the mobile device 300 is a notebook computer and includes a metal back cover 390 (positioned at an upper cover of the notebook computer). The aforementioned antenna structure 130 may be applied in the mobile device 300, adjacent to the metal back cover 390. FIG. 3B is a diagram of VSWR relative to the antenna structure 130 of the mobile device 300 according to an embodiment of the invention. According to the measurement of FIG. 3B, the antenna structure 130 of the mobile device 300 can at least cover a low-frequency band FB1 and a high-frequency band FB2. The low-frequency band FB1 may be from about 2400 MHz to about 2500 MHz. The high-frequency band FB2 may be from about 5150 MHz to about 5850 MHz.

As described in the embodiments of FIG. 2A, FIG. 2B, FIG. 3A, and FIG. 3B, the proposed antenna structure 130 of the invention can be applied to a tablet computer or a notebook computer with a metal back cover. Such an antenna structure 130 can support at least the dual-band operation of wireless local area network (WLAN) 2.4 GHz/5 GHz.

In some embodiments, the element sizes of the invention are as follows. The length of the first feeding radiation element 140 (from the first end 141 to the second end 142) is substantially equal to 0.5 wavelength (λ/2) of the low-frequency band FB1. The length of the second feeding radiation element 150 (from the first end 151 to the second end 152) is substantially equal to 0.25 wavelength (λ/4) of the high-frequency band FB2. The length of the first parasitic radiation element 160 (from the first end 161 to the second end 162) is substantially equal to 0.25 wavelength (λ/4) of the low-frequency band FB1. The length of the second parasitic radiation element 170 (from the first end 171 to the second end 172) is substantially equal to 0.25 wavelength (λ/4) of the low-frequency band FB1. The length of the third parasitic radiation element 180 (from the first end 181 to the second end 182) is substantially equal to 0.25 wavelength (λ/4) of the high-frequency band FB2. The width of each of the first coupling gap GC1, the second coupling gap GC2, and the third coupling gap GC3 is shorter than 3 mm. The total height of the supporting element 110 (from the second surface E2 to the peak point 115) is from about 2.5 mm to about 5 mm. For example, the total height of the supporting element 110 (from the second surface E2 to the peak point 115) may be from about 2.5 mm to about 3.5 mm. The total length LT1 of the antenna structure 130 is about 45 mm, and the total width WT1 of the antenna structure 130 is about 9.5 mm. The above size ranges are obtained according to many repeated experimental results, and they can help to optimize the antenna characteristics (e.g., the antenna gain) and the operation bandwidth of the antenna structure 130.

Figure 4:
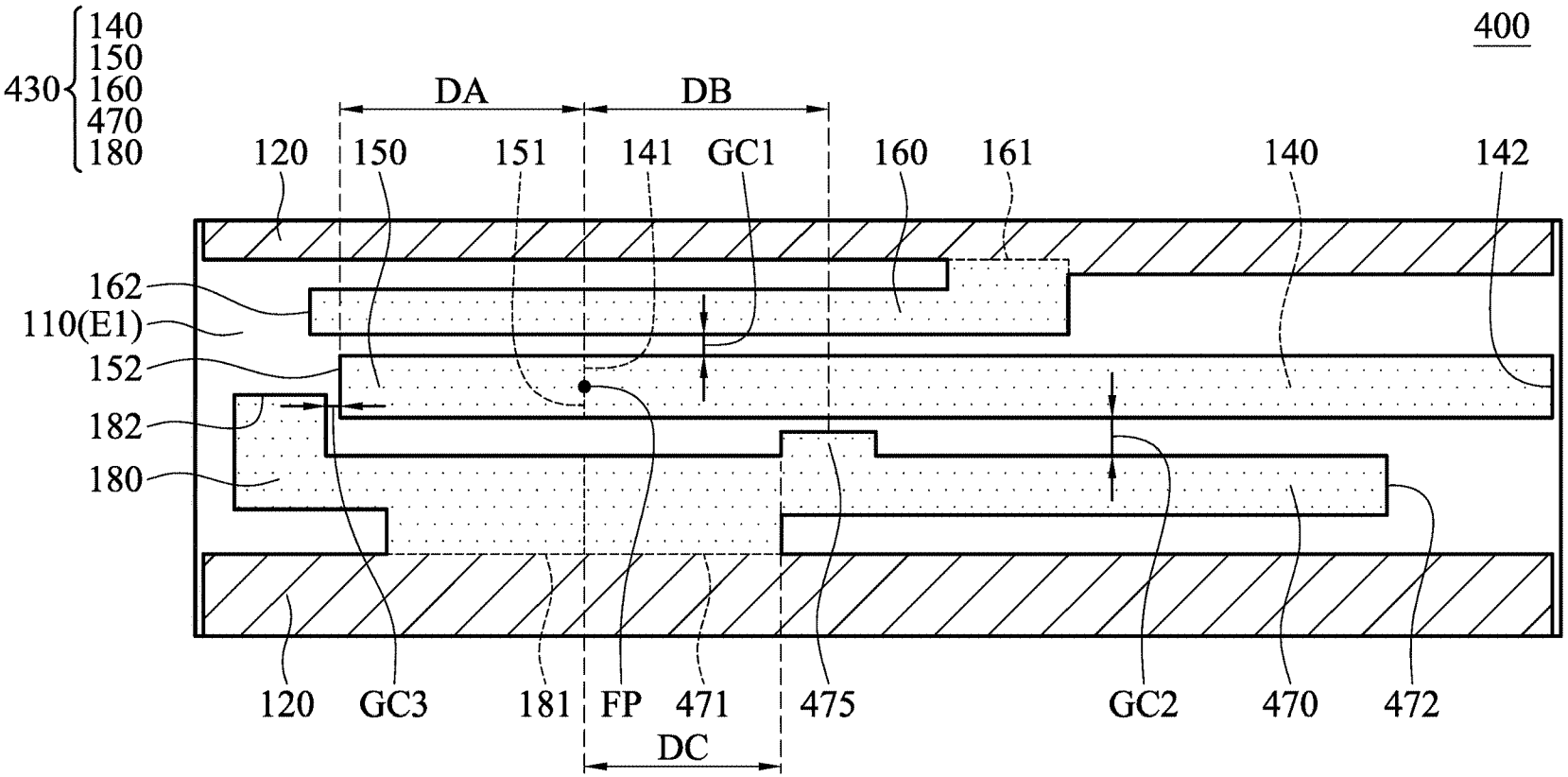
FIG. 4 is a plane expansion view of a mobile device according to another embodiment of the invention.
Figure 5:
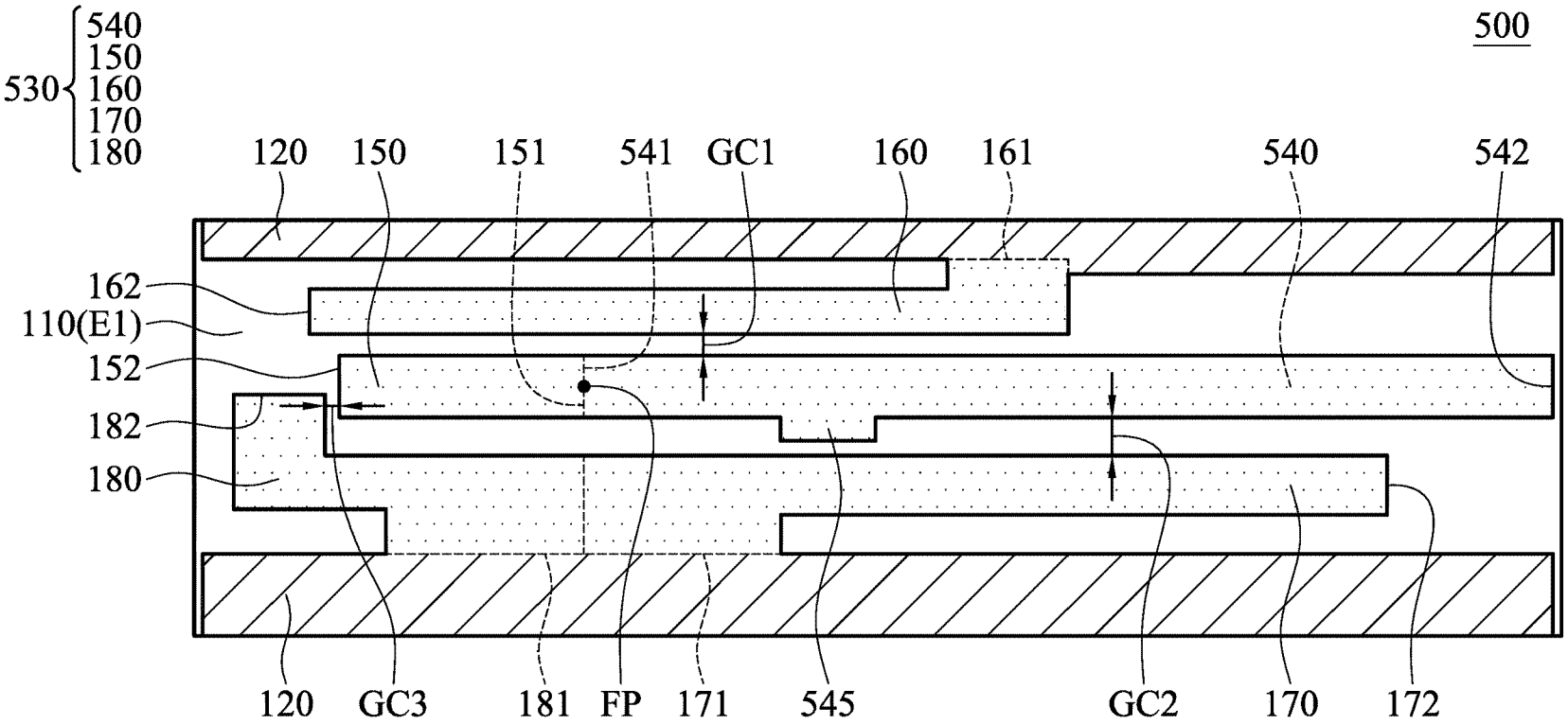
FIG. 5 is a plane expansion view of a mobile device according to another embodiment of the invention.

FIG. 4 is a plane expansion view of a mobile device 400 according to another embodiment of the invention. FIG. 4 is similar to FIG. 1A. The difference between the two embodiments is that in an antenna structure 430 of the mobile device 400, a second parasitic radiation element 470 further includes an extension portion 475. The extension portion 475 of the second parasitic radiation element 470 may substantially have a rectangular shape. The extension portion 475 of the second parasitic radiation element 470 extends toward the first feeding radiation element 140, so as to reduce the width of the second coupling gap GC2. For example, the width of the second coupling gap GC2 may be shorter than 2 mm or 1 mm around the extension portion 475 of the second parasitic radiation element 470. Specifically, the distance DB from a central point of the extension portion 475 of the second parasitic radiation element 470 to the signal feeding point FP may be substantially equal to the distance DA from the signal feeding point FP to the second end 152 of the second feeding radiation element 150. In some embodiments, the distance DC from the edge (adjacent to the signal feeding point FP) of the extension portion 475 of the second parasitic radiation element 470 to the signal feeding point FP may be substantially equal to the distance DA from the signal feeding point FP to the second end 152 of the second feeding radiation element 150. According to the practical measurement, with such a design, the extension portion 475 of the second parasitic radiation element 470 can help to fine-tune the impedance matching in a low-frequency band and to enhance the coupling effect between radiation elements, thereby improving the radiation performance of the antenna structure 430. In alternative embodiments, the aforementioned extension portion is added to the first parasitic radiation element 160 (as shown in FIG. 5 as follows) or the third parasitic radiation element 180, so as to enhance the coupling effect. Other features of the mobile device 400 of FIG. 4 are similar to those of the mobile device 100 of FIG. 1A. Accordingly, the two embodiments can achieve similar levels of performance.

FIG. 5 is a plane expansion view of a mobile device 500 according to another embodiment of the invention. FIG. 5 is similar to FIG. 4. The difference between the two embodiments is that in an antenna structure 530 of the mobile device 500, a first feeding radiation element 540 further includes an extension portion 545. The extension portion 545 of the first feeding radiation element 540 may substantially have a rectangular shape. The extension portion 545 of the first feeding radiation element 540 extends toward the second parasitic radiation element 170, so as to reduce the width of the second coupling gap GC2. Other features of the mobile device 500 of FIG. 5 are similar to those of the mobile device 400 of FIG. 4. Accordingly, the two embodiments can achieve similar levels of performance.

The invention proposes a novel mobile device and a novel antenna structure therein. In comparison to the conventional design, the invention can prevent the antenna structure from being affected by a metal back cover, so as to have the benefits of wideband operation and high antenna efficiency; however, the proposed design of the invention does not need to open an antenna window on the metal back cover or design a non-metal clearance region. Therefore, the invention is suitable for application in a variety of mobile communication devices with metal back covers.

Note that the above element sizes, element parameters, element shapes, and frequency ranges are not limitations of the invention. An antenna designer can fine-tune these settings or values according to different requirements. It should be understood that the mobile device and antenna structure of the invention are not limited to the configurations of FIGS. 1-5. The invention may merely include any one or more features of any one or more embodiments of FIGS. 1-5. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a supporting element, having a first surface and a second surface;

a ground element; and an antenna structure, disposed on the first surface of the supporting element, wherein the antenna structure comprises:

a first feeding radiation element, coupled to a signal feeding point;

a second feeding radiation element, coupled to the signal feeding point;

a first parasitic radiation element, coupled to the ground element, wherein a first coupling gap is formed between the first parasitic radiation element and the first feeding radiation element;

a second parasitic radiation element, coupled to the ground element, wherein a second coupling gap is formed between the second parasitic radiation element and the first feeding radiation element; and a third parasitic radiation element, coupled to the ground element, wherein a third coupling gap is formed between the third parasitic radiation element and the second feeding radiation element;

wherein the first feeding radiation element substantially has a straight-line shape with a length substantially equal to 0.5 wavelength of a low-frequency band, and the second feeding radiation element substantially has a straight-line shape with a length substantially equal to 0.25 wavelength of a high-frequency band.

2. The mobile device as claimed in claim 1, wherein the ground element extends from the second surface to the first surface of the supporting element.

3. The mobile device as claimed in claim 1, wherein at least a portion of the first surface of the supporting element is in a smooth arc-shape.

4. The mobile device as claimed in claim 3, further comprising:

a metal back cover, disposed adjacent to the supporting element, wherein the metal back cover is coupled through a conductive material to the ground element.

5. The mobile device as claimed in claim 4, wherein the first feeding radiation element is positioned at a point on the first surface of the supporting element having a perpendicular distance to the metal back cover greater than 50 percent of the longest perpendicular distance between the point and the metal back cover.

6. The mobile device as claimed in claim 5, wherein the point is a peak point on the smooth arc-shape of the first surface of the supporting element having the longest perpendicular distance between the peak point and the metal back cover.

7. The mobile device as claimed in claim 1, wherein the first feeding radiation element and the second feeding radiation element substantially extend in opposite directions.

8. The mobile device as claimed in claim 1, wherein the first parasitic radiation element is separated from the second parasitic radiation element and the third parasitic radiation element by a structure of the first feeding radiation element connected to the second feeding radiation element.

9. The mobile device as claimed in claim 1, wherein the low-frequency band is from about 2400 MHz to about 2500 MHz, and the high-frequency band is from about 5150 MHz to about 5850 MHz.

10. The mobile device as claimed in claim 9, wherein the first parasitic radiation element substantially has an L-shape, and a length of the first parasitic radiation element is substantially equal to 0.25 wavelength of the low-frequency band.

11. The mobile device as claimed in claim 9, wherein the second parasitic radiation element substantially has an L-shape, and a length of the second parasitic radiation element is substantially equal to 0.25 wavelength of the low-frequency band.

12. The mobile device as claimed in claim 9, wherein the third parasitic radiation element substantially has an N-shape, and a length of the third parasitic radiation element is substantially equal to 0.25 wavelength of the high-frequency band.

13. The mobile device as claimed in claim 9, wherein the first parasitic radiation element is excited by the first feeding radiation element using a coupling mechanism, so as to form the low-frequency band.

14. The mobile device as claimed in claim 9, wherein the second parasitic radiation element is further excited by the first feeding radiation element using a coupling mechanism, so as to widen the low-frequency band.

15. The mobile device as claimed in claim 9, wherein the third parasitic radiation element is excited by the second feeding radiation element using a coupling mechanism, so as to form the high-frequency band.

16. The mobile device as claimed in claim 1, wherein a width of each of the first coupling gap, the second coupling gap, and the third coupling gap is shorter than 3 mm.

17. The mobile device as claimed in claim 1, wherein the second parasitic radiation element further comprises an extension portion extending toward the first feeding radiation element, so as to reduce a width of the second coupling gap.

18. The mobile device as claimed in claim 1, wherein the first feeding radiation element further comprises an extension portion extending toward the second parasitic radiation element, so as to reduce a width of the second coupling gap.

19. An antenna structure, comprising:

a first feeding radiation element, coupled to a signal feeding point;

a second feeding radiation element, coupled to the signal feeding point;

a first parasitic radiation element, coupled to a ground element, wherein a first coupling gap is formed between the first parasitic radiation element and the first feeding radiation element;

a second parasitic radiation element, coupled to the ground element, wherein a second coupling gap is formed between the second parasitic radiation element and the first feeding radiation element; and a third parasitic radiation element, coupled to the ground element, wherein a third coupling gap is formed between the third parasitic radiation element and the second feeding radiation element;

wherein the first feeding radiation element substantially has a straight-line shape with a length substantially equal to 0.5 wavelength of a low-frequency band, and the second feeding radiation element substantially has a straight-line shape with a length substantially equal to 0.25 wavelength of a high-frequency band.

* * * * *